US005295884A

United States Patent [19]

Whiteley

[11] Patent Number: 5,295,884

[45] Date of Patent: Mar. 22, 1994

[54] FLOAT ASSEMBLY

[76] Inventor: Steven G. Whiteley, 64 Sandy Acres Close, Waterthorpe, Sheffield S19 6LT, England

[21] Appl. No.: 941,798

[22] Filed: Sep. 8, 1992

[30] Foreign Application Priority Data

Sep. 10, 1991 [GB] United Kingdom ..... 9119346

[51] Int. Cl.[5] ..... B63C 9/08

[52] U.S. Cl. ..... 441/122; 441/81

[58] Field of Search ..... 44/106, 108, 113, 114, 44/122, 129, 131, 133, 81

[56] References Cited

U.S. PATENT DOCUMENTS

| | | | |
|---|---|---|---|
| 2,724,843 | 11/1955 | Kimball | 441/131 |
| 3,498,246 | 3/1970 | Kiefer | 441/133 |
| 3,656,749 | 4/1972 | Reyes | 441/133 |
| 3,727,252 | 4/1973 | Bauermeister | 441/122 |
| 3,755,829 | 9/1973 | Walklet | 441/133 |
| 3,820,179 | 6/1974 | Maertin | 441/122 |
| 4,538,998 | 9/1985 | Holzel | 441/122 |
| 4,861,300 | 8/1989 | Casagrande et al. | 441/131 |
| 4,936,804 | 6/1990 | Dowdeswell | 441/122 |

FOREIGN PATENT DOCUMENTS

| | | | |
|---|---|---|---|
| 10594 | 1/1900 | Sweden | 441/108 |

*Primary Examiner*—David M. Mitchell
*Assistant Examiner*—Stephen P. Avila
*Attorney, Agent, or Firm*—Larson and Taylor

[57] ABSTRACT

The invention relates to a float assembly of the kind for use in childrens' swimming pools, the assembly having a core with a plurality of buoyant rings threaded thereon, the buoyant rings being made of plastics foam and being of two different outside diameters.

3 Claims, 3 Drawing Sheets

FLOAT ASSEMBLY

FIELD OF THE INVENTION

The invention relates to a float assembly of the kind used as an aid to maintaining a person afloat.

A typical kind of float in use at present is a conventional lifebuoy or motor vehicle tyre inner tube, that is to say a plain annular ring of either buoyant solid form or inflated endless tube form. This performs the required function of keeping a person afloat but has certain disadvantages. For example, it cannot easily be grasped by the hands of small children and is of fairly rigid form so that, when a swimmer is moving along a channel or flume of a width rather less than the outside diameter of the float, it can become wedged in position.

SUMMARY OF THE INVENTION

According to the invention, there is provided a float assembly for use in maintaining a person afloat comprising a core and a plurality of buoyant rings threaded thereon. The core may be tubular and may be in the form of a ring. If in the form of a ring, the core may be formed by a tubular length with juxtaposed ends joined by a smaller diameter connecting plug member inserted in said ends. The plug member may be retained in said ends by screws.

The float assembly may be provided with at least one cross piece spanning the core and having respective holes near its opposite ends through which the core extends. The or each cross piece may be formed by a plurality of link elements abutting together. Said link elements may be made of polyethylene foam material.

The buoyant rings may be made of plastics foam. There may be buoyant rings with a plurality of different outside diameters, arranged in alternation to each other. The larger diameter rings may abut together at the radially inner part of the ring form assembly.

DESCRIPTION OF THE PREFERRED EMBODIMENT

Figure 1:
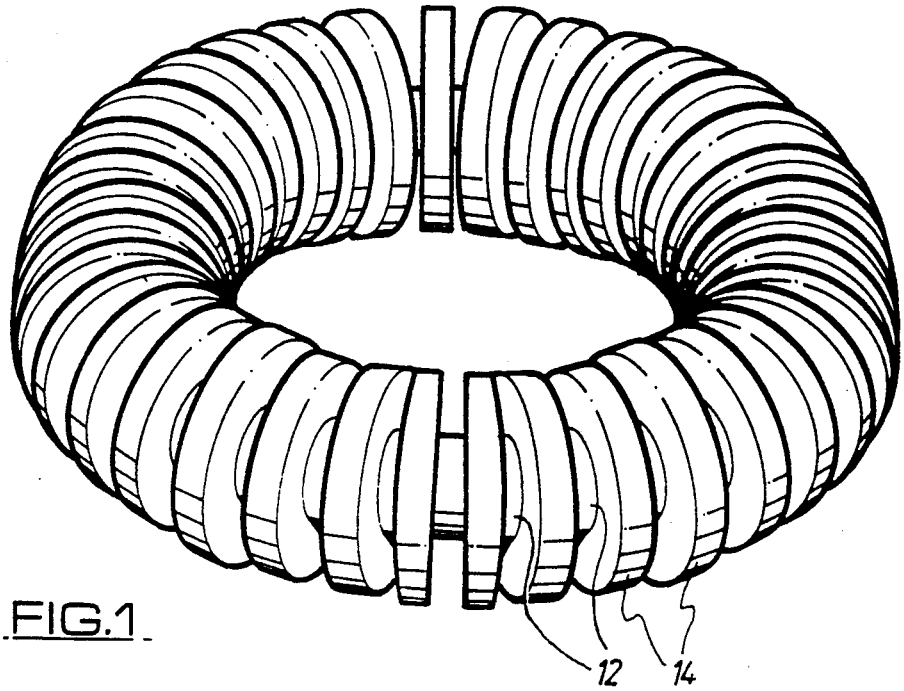
FIG. 1 is a perspective view of a float assembly embodying the invention.
Figure 2:
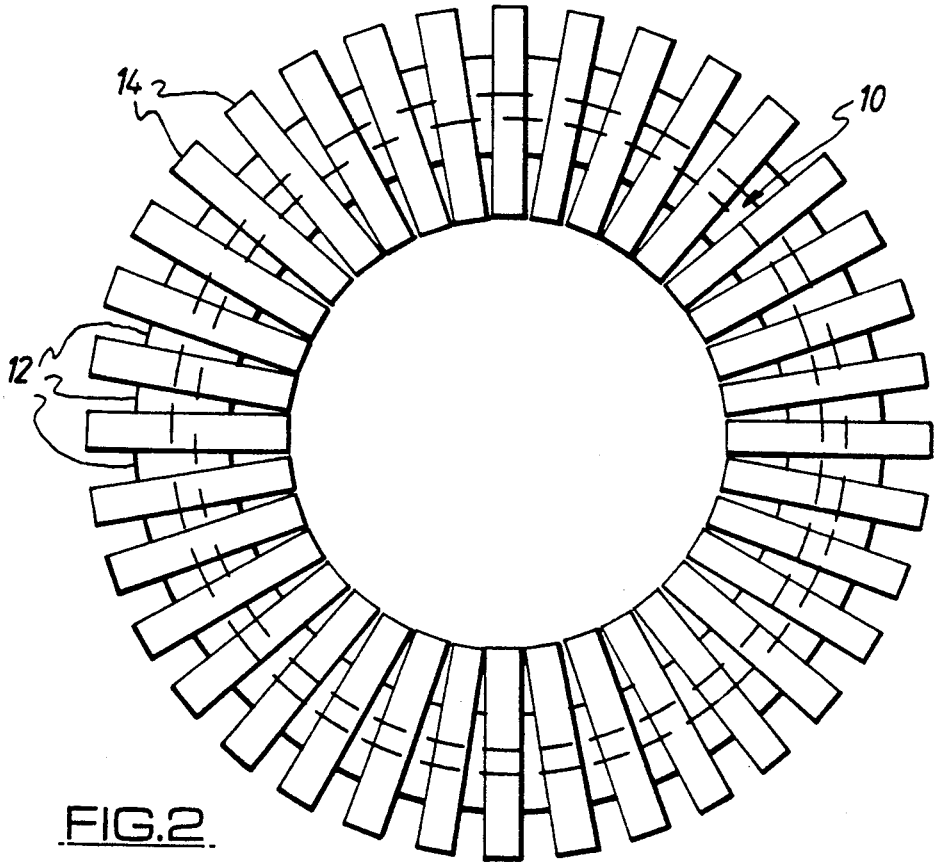
FIG. 2 is a plan view.

Referring now to FIGS. 1 and 2 of the drawings, the float assembly there illustrated is provided with a core 10 and with a plurality of buoyant rings made of polyethylene foam threaded thereon to abut together as shown, the buoyant rings being of two different external diameters, that is to say a plurality of smaller rings 12 and the same number of larger rings 14 arranged alternately. The nominal diameter of the core and the number, thickness, diameter and spacing of the larger diameter rings is such that said rings abut together at the radially inner part of the annulus which they form, as shown in FIG. 2, but, the rings being made of a resilient material, these dimensions are not critical.

Figure 3:
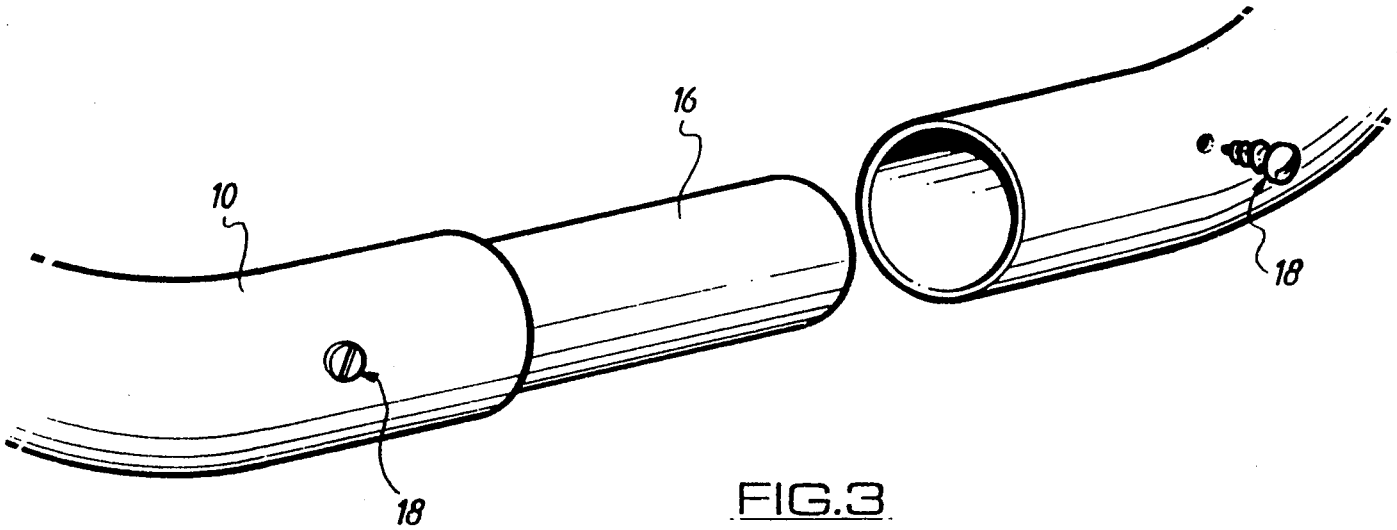
FIG. 3 is a scrap view illustrating a detail of construction.

Referring now to FIG. 3, this illustrates the fact that the core 10 has been made from a length of flexible pipe, for example polypropylene pipe, formed into a circle after the foam rings have been threaded thereon by its ends having been joined together. As shown, the opposite ends of the length of pipe have been connected together by a length of solid plastics bar 16 inserted into the opposite ends of said pipe and retained therein by respective screws 18.

Thus there is provided a construction of float which it has been found avoids the disadvantages of conventional floats. In particular, the projecting portions of the larger diameter rings provide convenient hand holds for the users of the float assembly, particularly for very small children who would find it difficult to grasp a part of a conventional float. The outside diameter of the float is easily deformed inwards so that it is not likely to become wedged in position in a narrow channel or flume.

The float assembly can be made in any convenient size. However, purely by way of example, the illustrated float is of 87 cm external diameter. The core has been made of 32 mm diameter tube and the foam discs have been made with a 35 mm bore, the external diameter of the smaller discs being 100 mm and the external diameter of the larger discs being 200 mm. The width of each disc is 28 mm. However, it will be understood that all these dimensions are variable.

POSSIBLE MODIFICATIONS

Figure 4:
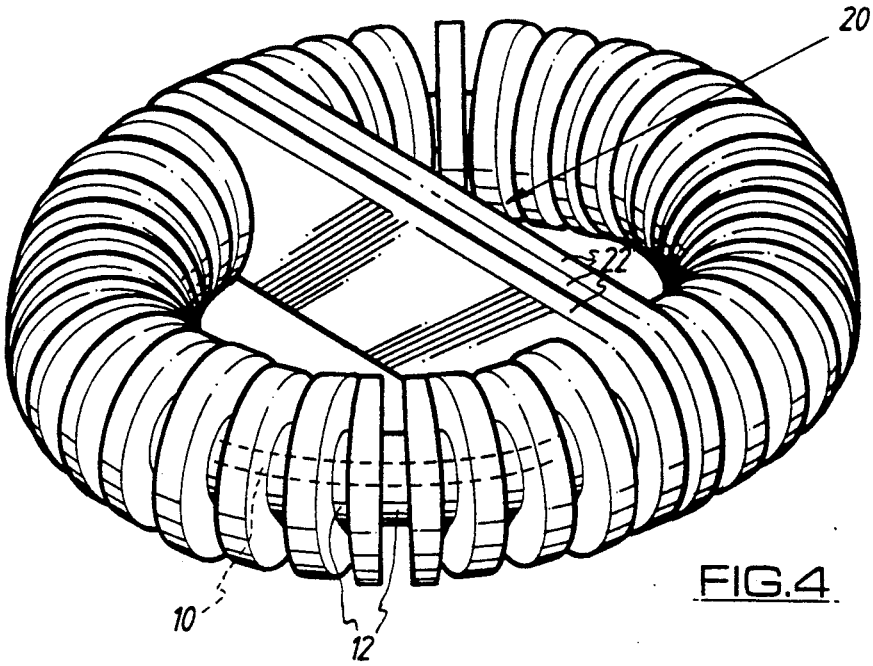
FIGS. 4 and 5 are views similar to FIG. 1 which illustrate possible modifications.

In FIG. 4 there is illustrated a modified form of float assembly very similar to that previously described except that it is provided with a central cross piece, generally indicated 20, made of a plurality of link elements 22 side by side. Each link element is an elongate plate made of polyethylene foam material with respective holes near its opposite ends through which the core 10 extends. This form of construction provides a float assembly having spaces within which two persons can place themselves.

Figure 5:
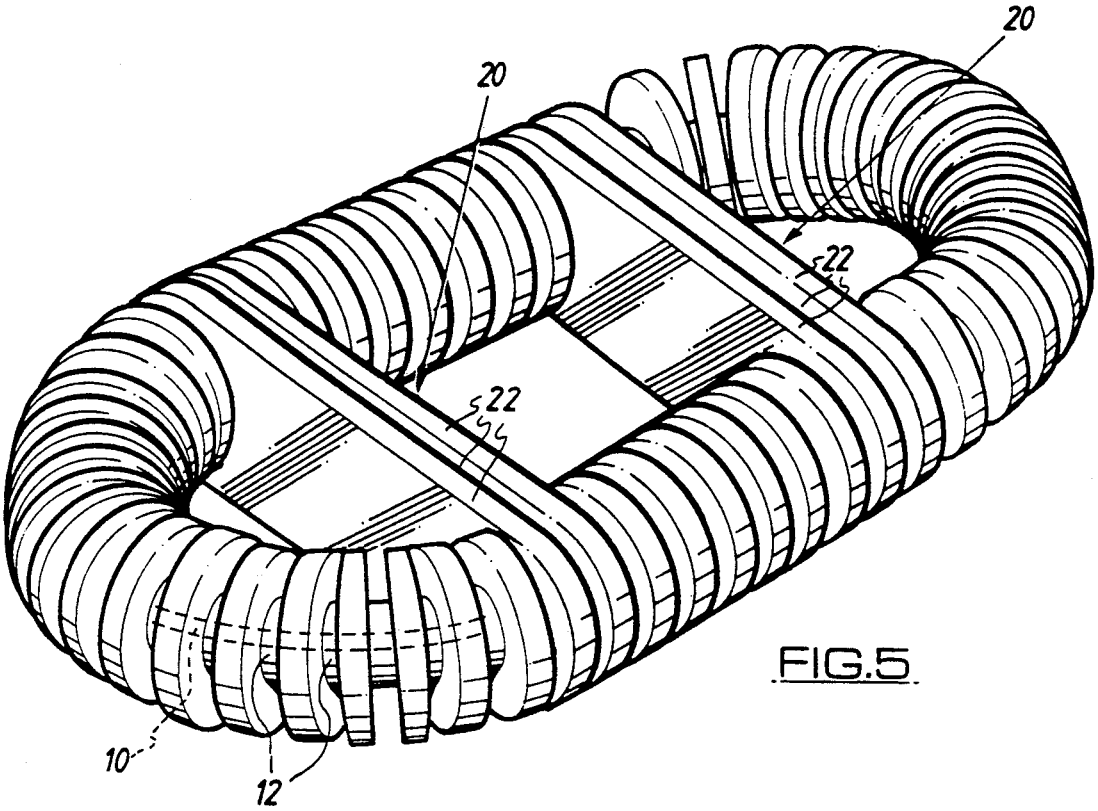

In FIG. 5 there is illustrated a construction similar to that of FIG. 4 except that it has been made somewhat longer and has two spaced cross pieces 20 each made of a plurality of the link elements 22. This form of construction provides a canoe-like float assembly which may be used by several persons.

Various other modifications may be made. For example, instead of the opposite ends of the length of pipe forming the core being connected together by means of screws, the length of solid bar could be secured in the ends of the pipe by an adhesive, but this would then mean that the rings could not be easily replaced when damaged as is the case with a float the opposite ends of the core of which have been joined together in the manner illustrated in FIG. 3. It would, however, be possible to make the core of flexible solid bar, for example of a synthetic plastics bar, the opposite ends of which could be connected together by a thin walled sleeve element.

I claim:

1. A float assembly for use in maintaining a person afloat, said assembly comprising a tubular core in the form of a ring and a plurality of buoyant rings made of plastics foam threaded on said core, the buoyant rings being of a plurality of different diameters and said buoyant rings of different diameters being arranged in alternation to each other, and the core being formed by a length of material having opposite ends juxtaposed and provided with interconnection means for forming said core into a closed loop, said rings overlying said core so as to substantially cover said interconnection means, the length of material comprising a tubular length with juxtaposed ends joined by a smaller diameter connecting plug member inserted in said ends and constituting said interconnection means.

2. A float assembly for use in maintaining a person afloat, said assembly comprising a core and a plurality of buoyant rings made of plastic foam threaded on said core, the buoyant rings being of a plurality of different diameters and said buoyant rings of different diameters being arranged in alternation to each other, and the core being formed by a length of material having opposite ends juxtaposed and provided with interconnection means for forming said core into a closed loop, said rings overlying said core so as to substantially cover said interconnection means, said assembly further comprising at least one cross piece spanning the core, said at least one cross piece being formed by a plurality of link elements abutting together and having respective holes near their opposite ends through which the core extends.

3. A float assembly for use in maintaining a person afloat, said assembly comprising a core and a plurality of buoyant rings made of plastic foam threaded on said core, the buoyant rings being of a plurality of different diameters and said buoyant rings of different diameters being arranged in alternation to each other, and the core being formed by a length of material having opposite ends juxtaposed and provided with interconnection means for forming said core into a closed loop, said rings overlying said core so as to substantially cover said interconnection means, said core being in the form of a ring and the buoyant rings of larger diameter abutting together at the radially inner part of the float assembly.

* * * * *